United States Patent [19]

Miller

[11] 4,295,564

[45] Oct. 20, 1981

[54] HANGER ASSEMBLY FOR MERCHANDISE

[75] Inventor: Fred J. Miller, Memphis, Tenn.

[73] Assignee: Arthur Fulmer of Mississippi, Inc., Memphis, Tenn.

[21] Appl. No.: 113,332

[22] Filed: Jan. 18, 1980

[51] Int. Cl.[3] ..... B65D 85/18

[52] U.S. Cl. ..... 206/279; 206/281; 206/289

[58] Field of Search ..... 206/279, 281, 284, 286, 206/287, 289; 220/4 F, 6

[56] References Cited

U.S. PATENT DOCUMENTS

| | | | |
|---|---|---|---|
| 1,780,558 | 11/1930 | Kavanau | 206/281 |
| 2,380,375 | 7/1945 | Axelrod | 206/286 |
| 3,360,180 | 12/1967 | Venturi | 220/6 |
| 3,575,312 | 4/1971 | Luisada | 220/4 F |
| 3,874,546 | 4/1975 | Sanders et al. | 220/6 |
| 3,941,271 | 3/1976 | Zarges et al. | 220/6 |
| 4,091,976 | 5/1978 | Morse | 206/279 |
| 4,190,151 | 2/1980 | Russell | 206/281 |
| 4,244,453 | 1/1981 | Herz | 206/289 |

FOREIGN PATENT DOCUMENTS

| | | | |
|---|---|---|---|
| 2248676 | 5/1975 | France | 206/289 |

*Primary Examiner*—Joseph Man-Fu Moy

*Attorney, Agent, or Firm*—Schmidt, Johnson, Hovey & Williams

[57] ABSTRACT

An improved, crush resistant, multiple use merchandise hanger assembly is disclosed which allows hanging or stacking of merchandise as desired. The assembly includes a two-flap, merchandise-receiving label having an upstanding tab, and a hook pivotally secured to the tab. The tab is apertured and provided with an arcuate hook-receiving slot for accommodating pivoting of the hook. The label includes strategically located transverse lines of weakness therein so as to safely absorb bending or impact forces during shipping and handling without harming the label. In use, the hook can be selectively shifted to an upright operative position for suspending the merchandise, or can alternately be pivoted to a lowered, recessed position permitting normal stacking of the merchandise.

4 Claims, 5 Drawing Figures

HANGER ASSEMBLY FOR MERCHANDISE

BACKGROUND OF THE INVENTION

1. Field of the Invention

The present invention is concerned with an improved hanger assembly for merchandise such as ventilated automotive cushions which allows the retailer to display the merchandise either from racks in a suspended fashion, or in stacks. More particularly, it is concerned with such a dual purpose hanger assembly which includes a pivotally mounted hook and strategically located lines of weakness which assure that the merchandise label remains intact during normal shipping and handling.

2. Description of the Prior Art

Generally speaking, retailers of merchandise oftentimes desire flexibility in techniques of display. For example, some retailers may desire to suspend certain types of articles from racks or the like, while others may find it more convenient and appropriate to simply stack the same items. Accordingly, suppliers to the retailers often will seek to package their products in ways which will accommodate the diverse demands of the retailers. At the same time, to be cost effective, any display structure provided by the supplier must be low in cost and not detract from the aesthetic appearance of the products to be displayed. Finally, display devices should be sufficiently sturdy to be able to safely absorb bending or impact forced encountered during normal shipping and handling. As can be appreciated, it does little good to provide expensive labels and/or display structures if the same become destroyed or inoperative prior to reaching the retailer.

Prior hangers and similar merchandise display units are described in U.S. Pat. Nos. 3,144,721, 4,011,946, 4,071,140, 3,132,742, 3,302,917 3,670,947, 3,695,418, 3,862,687 and 3,999,656.

SUMMARY OF THE INVENTION

The present invention overcomes all of the problems mentioned above and provides a particularly useful, dual purpose crush-resistant hanger assembly for merchandise display purposes. To this end, the invention provides a two-flap merchandise receiving label having an upstanding tab portion. A hook is pivotally secured to the tab portion and is shiftable between an upright, operative position, and a lowered, recessed position. The tab portion is provided with an arcuate slot for accommodating pivoting of the hook as desired.

In preferred forms of the invention, first and second lines of weakness are provided in the label at strategic locations so as to bend if undue impact forces are encountered during shipping and handling. In this way the label retains both its appearance and usefulness.

DESCRIPTION OF THE PREFERRED EMBODIMENT

Figure 2:
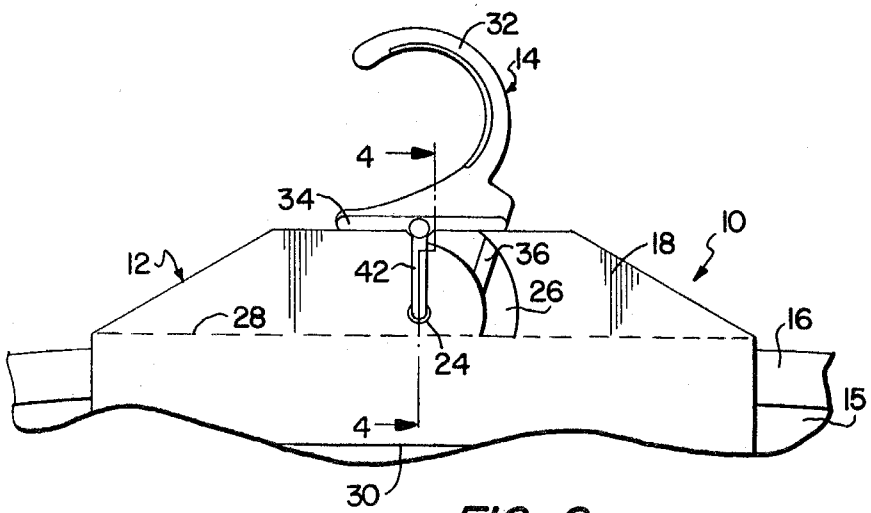
FIG. 2 is an enlarged fragmentary side view illustrating in detail the hanger assembly.

Turning now to the drawing, a hanger assembly 10 in accordance with the invention broadly includes a two-flap label 12 and a pivotal hook 14 operatively secured to the label. The hook 14 is shiftable between an upright, operative position depicted in FIG. 2, and a recessed, lowered position illustrated in FIG. 3. In the embodiment illustrated, the assembly 10 is operatively mounted on a ventilated automotive cushion 15 having the marginal, outwardly extending lip 16. It is to be understood however, that assembly 10 is usable with a wide variety of specific items requiring display.

In more detail, label 12 is formed from a single piece of cardboard or other appropriate paper stock which is folded to present an uppermost, two-ply adhesively interconnected tab 18 with a pair of depending flaps 20, 22 depending therefrom. As illustrated, the flap 20 is significantly larger than flap 22, and is designed to carry merchandising information or other indicia thereon.

Figure 4:
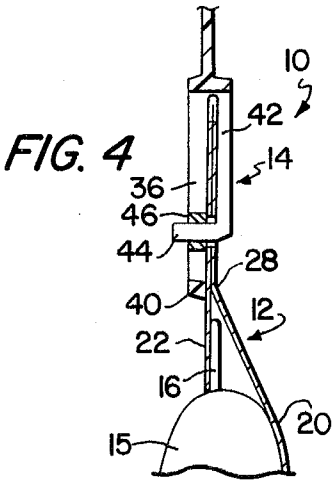
FIG. 4 is a sectional view taken along line 4—4 of FIG. 2.
Figure 5:
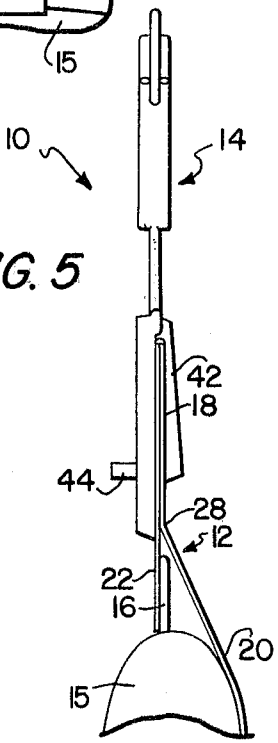
FIG. 5 is a fragmentary end view of the assembly.

Tab portion 18 is apertured as at 24 and is further provided with an elongated, arcuate slot 26 therein. It will also be observed that a line of perforation 28 extends through and defines the lowermost margin of the flap portion 18. As best seen in FIGS. 4 and 5, respective flaps 20, 22 join tab portion 18 at the perforation line 28. Finally, a secondary line of weakness in the form of a transversely extending score line 30 is provided in larger flap 20 below and parallel to perforation line 28.

Hook 14 is formed of a suitable synthetic resin material and includes an arcuate hook section 32, an elongated base 34, and a pair of elongated, converging marginal legs 36, 38 extending from the base 34. A short segment 40 interconnects the legs 36, 38 at a point remote from the base 34.

The hook 14 further includes a central, depending leg 42 connected to base 34 between legs 36, 38 and terminating in a short, transversely extending stub 44. As will be readily appreciated from a study of FIGS. 2 and 3, hook 14 is mounted on tab portion 18 in such manner that the legs 36, 38 engage the rearward face of the tab whereas central leg 42 engages the front face thereof directly above larger flap 20. Also, the stub 44 extends through aperture 24 of the tab portion, and a retainer clip 46 is secured to the stub adjacent the rear face of the tab. In this manner, the hook 14 is pivotal about the axis defined by stub 44, with slot 26 accommodating such pivoting. That is to say, it will be observed that the upper portion of central leg 42 adjacent base 34 rides in the slot 26 during pivoting of hook 14.

In the use of hanger assembly 10, the flaps 20, 22 are separated by pivoting each of the latter about the axis defined by perforation line 28, whereupon the upper margin of cushion 15 including lip 16 is inserted between the flaps. At this point the flaps and tab 16 are appropriately connected, for example by using staples (not shown) or other conventional means. In this orientation longer flap 20 will extend down one face of the cushion 15 for display and informational purposes.

Figure 3:
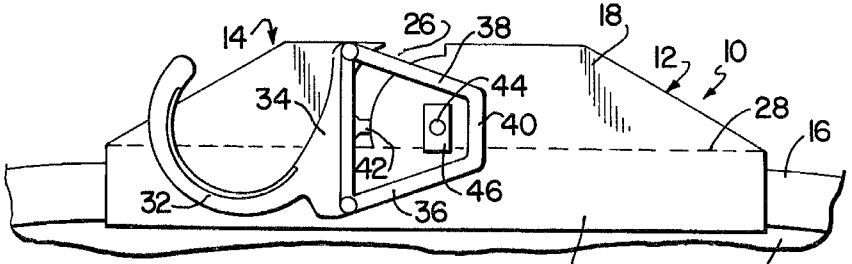
FIG. 3 is a view similar to that of FIG. 2, but illustrating the opposite side of the assembly and depicting the hook in its lowered, recessed position.

During shipping and handling of the cushion 15, hook 14 will be shifted to its lowered, recessed position illustrated in FIG. 3. In this orientation the hook is below the upper margin of tab portion 18, so that the overall structure takes up a minimum of space. In the event that the assembly 10 is subjected to impact or bending forces, the strategically located lines of weakness in the form of perforation line 28 and score line 30 serve to allow bending of the label 12 without crushing or destruction thereof.

Figure 1:
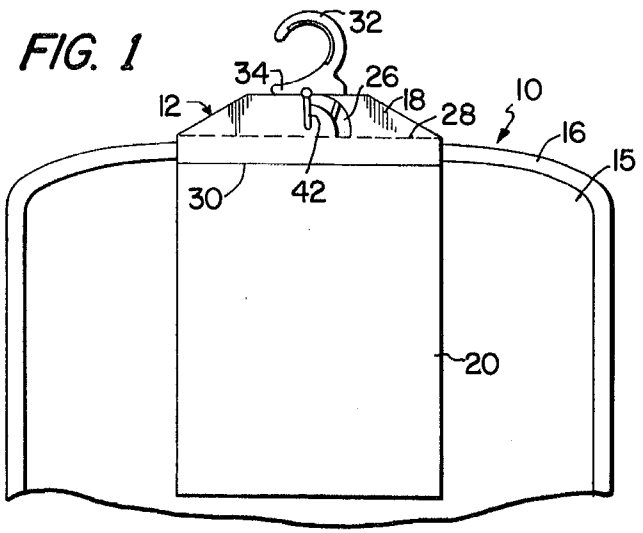
FIG. 1 is a fragmentary side view illustrating a ventilated automotive cushion having the hanger assembly of the present invention operatively mounted thereon.

When the cushion 15 reaches the retailer, it can be hung from racks or the like simply by pivoting hook 14 to its upper, operative position illustrated in FIG. 1, or the hook can be retained in its lowered position if the retailer desires to stack the cushions. In either case the assembly 10 gives the retailer desirable flexibility in displaying his wares.

Having thus described the invention, what is claimed as new and desired to be secured by Letters Patent is:

1. A hanger assembly for displaying merchandise, comprising:

a label including a pair of juxtaposed flaps adapted to receive therebetween merchandise to be displayed, and a normally upstanding tab secured to at least one of said flaps and extending above said merchandise;

structure defining an arcuate slot in said tab;

a hook for suspending said assembly and merchandise; means pivotally mounting said hook to said tab for selective movement of the hook between an upright operative position and a lowered, recessed position below the upper margin of the tab, said slot being configured and arranged to accommodate pivoting of said hook between said positions, said hook and mounting means therefor comprising— an arcuate section having a base;

a pair of spaced apart marginal legs secured to the base of said arcuate section and extending away from the same;

a segment connecting the ends of said marginal legs remote from said arcuate section;

a central leg disposed between said marginal legs and extending away from said section;

a laterally extending stub secured to the end of said central leg remote from said section for defining a pivot axis for said hook, there being structure defining an aperture through said at least one flap receiving said stub;

retainer means secured to said stub and adjacent the face of said one flap remote from said central leg, said slot being oriented for receiving a portion of said central leg during said pivoting of the hook.

2. The assembly as set forth in claim 1 including a first line of weakness at the line of juncture between said tab and said at least one flap.

3. The assembly as set forth in claim 2 including a second line of weakness parallel to said first line of weakness and in said at least one flap.

4. The assembly as set forth in claim 1, said tab being defined by interconnected portions of said first and second flaps, one of said flaps being longer than the other flap, there being a line of perforation in said interconnected flaps defining a line of connection of the pair of flaps, and a line of weakness in said longer flap spaced from and parallel to said line of perforation.

* * * * *